US009739044B1

(12) United States Patent
Files, Jr.

(10) Patent No.: US 9,739,044 B1
(45) Date of Patent: Aug. 22, 2017

(54) CONTINUOUS SLOT TRENCH DRAIN

(71) Applicant: Rapid Trench, LLC, Vancouver, WA (US)

(72) Inventor: Patrick T. Files, Jr., Vancouver, WA (US)

(73) Assignee: Rapid Trench, LLC, Vancouver, WA (US)

( * ) Notice: Subject to any disclaimer, the term of this patent is extended or adjusted under 35 U.S.C. 154(b) by 2 days.

(21) Appl. No.: 15/047,368

(22) Filed: Feb. 18, 2016

(51) Int. Cl.

| | |
|---|---|
| ***E03F 1/00*** | (2006.01) |
| ***E02B 11/00*** | (2006.01) |
| ***E03F 5/04*** | (2006.01) |
| ***E01C 11/22*** | (2006.01) |

(52) U.S. Cl.
CPC ..... *E03F 1/00* (2013.01); *E01C 11/227* (2013.01); *E02B 11/005* (2013.01); *E03F 5/0401* (2013.01)

(58) Field of Classification Search
CPC ..... E03F 1/00; E03F 5/0401; E01C 11/227; E02B 11/005
See application file for complete search history.

(56) References Cited

U.S. PATENT DOCUMENTS 3,815,213 A * 6/1974 Evans ..... E01C 11/227 228/182
4,490,067 A * 12/1984 Dahowski ..... E01C 11/227 404/4
4,787,773 A * 11/1988 Kehler ..... E03F 3/046 404/4
4,815,888 A * 3/1989 Stegmeier ..... E04F 15/14 210/164
4,838,727 A * 6/1989 Capuano ..... E01C 11/227 404/2
5,281,052 A * 1/1994 Beamer ..... E03F 3/046 249/11
5,380,121 A * 1/1995 Schluter ..... E01C 11/227 210/164
5,454,663 A * 10/1995 Stegmeier ..... E04H 4/1227 404/2
5,908,266 A * 6/1999 Miller ..... E01C 11/227 404/2
6,000,881 A * 12/1999 Becker ..... E03F 3/046 404/4
6,663,317 B1 * 12/2003 Williams ..... E03F 3/046 404/3
6,746,179 B1 * 6/2004 Kerkhoff ..... A01K 1/0103 404/2

(Continued)

OTHER PUBLICATIONS

2014 U-drain Product Brochure, available at http://web.archive.org/save/_embed/http://www.u-drain.ca/uploads/2/3/9/7/23979925/u-drain_brochure_2014.pdf. Internet archive indicates that the brochure was available Feb. 22, 2015.

*Primary Examiner* — Benjamin Fiorello
(74) *Attorney, Agent, or Firm* — Klarquist Sparkman, LLP

(57) ABSTRACT

In one representative embodiment, a trench drain comprises first and second end portions, a channel portion extending longitudinally from the first end portion to the second end portion, a continuous, unobstructed slot portion extending from and in fluidic communication with the channel portion, wherein the slot portion and the channel portion form an internal flow passage, and at least one gusset coupled to the slot portion and the channel portion and disposed external to the internal flow passage.

21 Claims, 5 Drawing Sheets

(56) References Cited

U.S. PATENT DOCUMENTS

| | | | | |
|---|---|---|---|---|
| 7,264,418 | B1 * | 9/2007 | Houck | E01C 11/227 404/2 |
| 7,866,911 | B2 * | 1/2011 | Saadi | E03F 3/046 138/162 |
| 7,967,523 | B2 * | 6/2011 | Hetzler | E03F 3/046 404/2 |
| 2003/0185628 | A1 * | 10/2003 | Muller | E01C 11/225 405/40 |
| 2007/0166105 | A1 * | 7/2007 | Rzadkowolski | E03F 3/046 405/43 |
| 2013/0142573 | A1 * | 6/2013 | Humphries | E02B 11/005 405/48 |

* cited by examiner

CONTINUOUS SLOT TRENCH DRAIN

FIELD

This disclosure generally concerns trench drains.

BACKGROUND

Trench drains are typically used where there is a need to drain a generally flat surface, such as a sidewalk, driveway, overhead or garage door opening, factory floor, airport apron, or roadway median. Trench drains collect liquid runoff and deliver the runoff to a collection system, such as a sewer system.

Trench drains are typically U-shaped or V-shaped channels or troughs which are covered with grating to prevent large debris, people, and/or other objects from falling into the channel. Internal supports are also typically placed within the channel to support the trench drain channel. Due to the grating and internal supports, trench drain channels can become clogged and can be difficult and time consuming to clean. The grating can also be aesthetically unpleasant or intrusive which can make the trench drain undesirably noticeable. Thus, there is a continuing need for improved trench drains.

SUMMARY

Described herein are examples of trench drains, trench drain systems, and components thereof which are relatively easy and efficient to clean and provide pleasing aesthetics.

In one representative embodiment, a trench drain comprises first and second end portions, a channel portion extending longitudinally from the first end portion to the second end portion, a continuous, unobstructed slot portion extending from and in fluidic communication with the channel portion, wherein the slot portion and the channel portion form an internal flow passage, and at least one gusset coupled to the slot portion and the channel portion and disposed external to the internal flow passage.

In some embodiments, the internal flow passage is unobstructed. In some embodiments, the slot portion comprises two laterally spaced rails which are coupled to and extend from the channel portion. In some embodiments, each of the rails comprises an exposed edge portion when the trench drain is installed, and a thickness of each of the exposed edge portions of the rails is less than 0.3 inches.

In some embodiments, an opening in the slot portion comprises a width of less than or equal to one inch. In particular embodiments, an opening in the slot portion comprises a width of 0.125-0.625 inches.

In some embodiments, the trench drain further comprises at least one additional gusset coupled to the slot portion and the channel portion and disposed external to the internal flow passage, wherein the at least one additional gusset is longitudinally spaced from the at least one gusset. In some of those embodiments, the trench drain further comprises a support member coupled to and extending between the at least one gusset and the at least one additional gusset. In some of those embodiments, each of the gussets comprises an attachment location for receiving the support member.

In some embodiments, the trench drain further comprises a first support member coupled to and extending between the at least one gusset and the at least one additional gusset and which is disposed on a first side of the slot portion, and a second support member coupled to and extending between the at least one gusset and the at least one additional gusset and which is disposed on a second side of the slot portion. In some embodiments, the gusset comprises a rounded or rolled edge portion.

In some embodiments, the trench drain further comprises trim elements disposed over respective rails of the slot portion. In some embodiments, the trim elements are removeable after the trench drain is installed.

In some embodiments, the channel portion and the slot portion are formed from a single, unitary piece of material. In some embodiments, the channel portion and the slot portion each comprise a thickness, and the thickness of the channel portion and the thickness of the slot portion are substantially the same.

In some embodiments, the trench drain is formed from stainless steel. In other embodiments, the trench drain is formed from galvanized steel. In other embodiments, the trench drain is formed from plastic.

In another representative embodiment, a modular trench drain system comprises a plurality of trench drain sections that are coupled together, wherein each of the trench drain sections comprises two laterally spaced rails defining a continuous, unobstructed slot extending laterally between the rails and longitudinally from a first end portion to a second end portion of the trench drain section, and external ribbing coupled to and extending laterally away from at least one of the rails.

In some embodiments, each of the trench drain sections comprises a mounting tab. In some embodiments, each of the trench drain sections comprises a channel portion having angled side portions, and the external ribbing is coupled to at least one of the angled side portions.

The foregoing and other objects, features, and advantages of the disclosed trench drains, trench drain systems, and components thereof will become more apparent from the following detailed description, which proceeds with reference to the accompanying figures.

DETAILED DESCRIPTION

Figure 1:
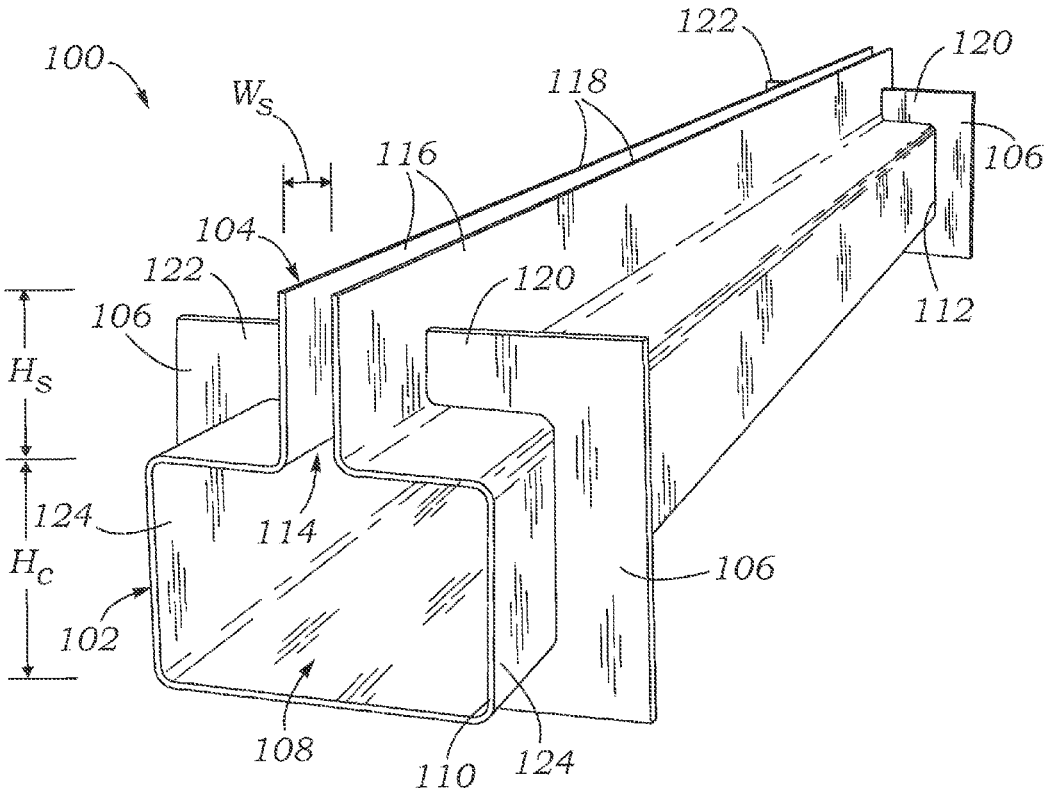
FIG. 1 is perspective view of an example of a trench drain, according to one embodiment.

For purposes of this description, certain aspects, advantages, and novel features of the embodiments of this disclosure are described herein. The disclosed methods, apparatuses, and systems should not be construed as limiting in any way. Instead, the present disclosure is directed toward all novel and nonobvious features and aspects of the various disclosed embodiments, alone and in various combinations and sub-combinations with one another. The methods, apparatuses, and systems are not limited to any specific aspect or feature or combination thereof, nor do the disclosed embodiments require that any one or more specific advantages be present or problems be solved.

Although the operation of some of the disclosed methods are described in a particular, sequential order for convenient presentation, it should be understood that this manner of description encompasses rearrangement, unless a particular ordering is required by specific language. For example, operations described sequentially may in some cases be rearranged or performed concurrently. Moreover, for the sake of simplicity, the attached figures may not show the various ways in which the disclosed methods can be used in conjunction with other methods.

As used herein, the terms "a", "an" and "at least one" encompass one or more of the specified element. That is, if two of a particular element are present, one of these elements is also present and thus "an" element is present. The terms "a plurality of" and "plural" mean two or more of the specified element.

As used herein, the term "and/or" used between the last two of a list of elements means any one or more of the listed elements. For example, the phrase "A, B, and/or C" means "A," "B," "C," "A and B," "A and C," "B and C" or "A, B and C."

As used herein, the term "coupled" generally means physically coupled or linked and does not exclude the presence of intermediate elements between the coupled items absent specific contrary language.

Described herein are examples of trench drains, trench drain systems, and components thereof which are relatively easy and efficient to clean and provide pleasing aesthetics.

These trench drains comprise a continuous, unobstructed slot. The slot is configured to be used without grating covering the slot. The trench drain also comprises external gussets or ribbing which are used to support the slot, thus eliminating the need for internal supports. As a result, there is a reduced incidence of unsightly debris that becomes trapped in the slot, and the trench drain is relatively easy to clean compared to typical trench drains.

In some embodiments, the trench drain is configured such that the slot is discretely disposed between pavers or concrete joints so that the slot blends in with grout or joint lines. This configuration advantageously improves the overall aesthetics of a trench drain system.

It should be noted that, although single trench drain sections are shown and described herein, in some embodiments, the trench drain sections are connected together to form a continuous run or length as part of a trench drain system. In such embodiments, the trench drain sections are coupled or secured to each other, for example, by fasteners (e.g., bolts, screws, etc.), welding, an adhesive, couplers, etc.

Figure 2:
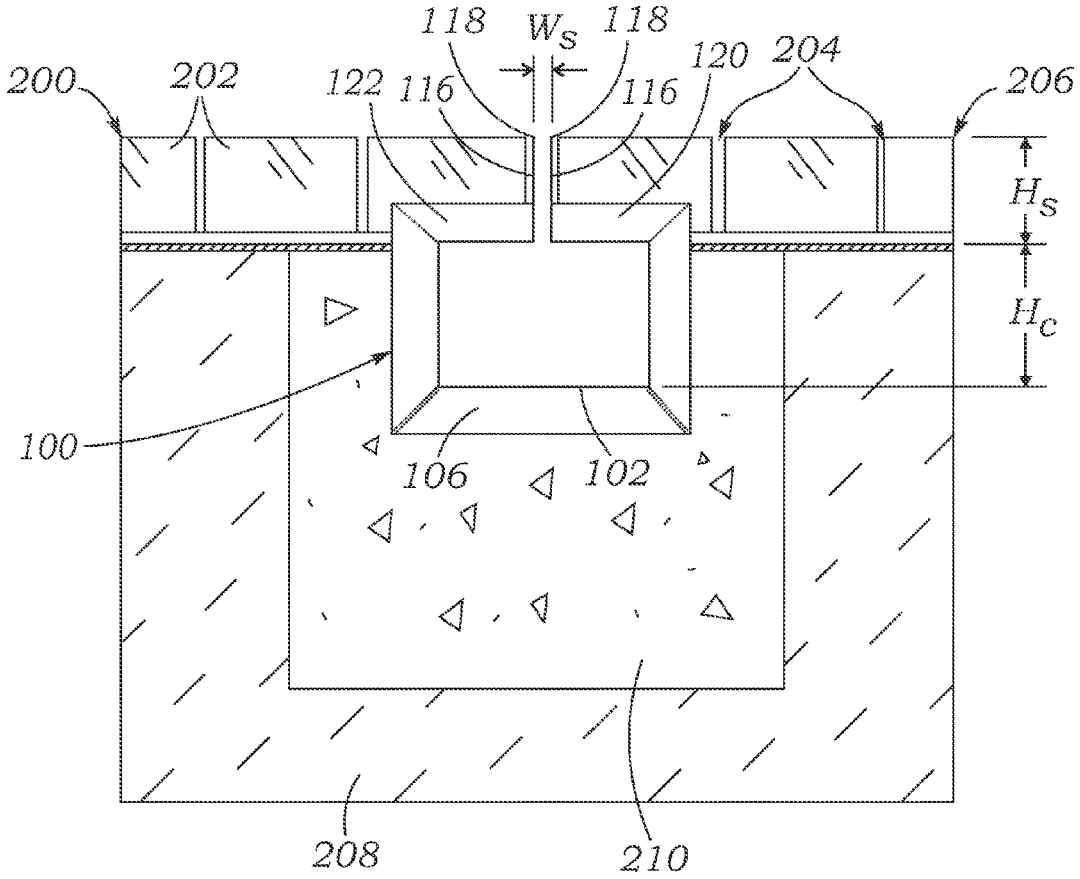
FIG. 2 is an end view of the trench drain of FIG. 1 installed at a site, which is shown in cross-sectional view.

FIGS. 1-2 show an example of a trench drain section 100, according to one embodiment. Referring to FIG. 1, the trench drain section 100 comprises a channel portion 102, an unobstructed slot portion 104, and one or more gussets (which is also called ribbing) 106 (e.g., two in the illustrated embodiment). The slot portion 104 is in fluidic communication with the channel portion 102 to form an internal flow passage 108, as further described below. The gussets 106 are coupled or secured to the channel portion 102 and the slot portion 104, external to the internal flow passage 108, so that the internal flow passage 108 is unobstructed.

The channel portion (which is also called a trough) 102 of the trench drain section 100 is substantially tubular and extends longitudinally from a first end portion 110 of the trench drain section 100 to a second end portion 112 of the trench drain section 100. As shown in the illustrated embodiment, the channel portion 102 comprises a generally rectangular cross-sectional shape. In other embodiments, the channel portion 102 comprises various other cross-sectional shapes (see, e.g., FIGS. 6-7).

Referring again to FIG. 1, the channel portion 102 has an opening 114 which extends longitudinally along a top portion of the channel portion 102. The opening 114 allows a fluid and/or other substances to enter the channel portion 102.

The unobstructed slot portion 104 of the trench drain section 100 is formed by two laterally spaced rails or flanges 116 which are disposed on the channel portion 102 adjacent to the opening 114 of the channel portion 102. Each of the rails 116 of the slot portion 104 extend away from a respective side of the opening 114 of the channel portion 102. Thus, the channel portion 102 and the slot portion 104 form the unobstructed internal flow passage 108 and are in fluidic communication with each other. For example, a fluid and/or other substance can flow into and through the channel portion 102 and the slot portion 104 of the trench drain section 100 via the internal flow passage 108.

The rails 116 are spaced apart relative to each other to form an opening having a width $W_s$. For example, in some embodiments, the width $W_s$ of the opening in slot portion 104 is less than or equal to about one inch. In certain embodiments, the width $W_s$ of the opening in the slot portion 104 is about 0.125 inches to about 0.625 inches. In particular embodiments, the width of the opening in the slot $W_s$ is about 0.25 inches or about 0.5 inches.

Configuring the opening of the slot portion 104 with a relatively narrow width $W_s$ allows the slot portion 104 to blend in with grout lines between pavers or joint lines in a concrete slab. For example, FIG. 2 shows the trench drain section 100 installed at a site 200 such that the rails 116 of the slot portion 104 (shown in FIG. 1) are disposed between pavers 202 (e.g., parallel to grout lines 204). This configuration advantageously allows the trench drain section 100 to be relatively inconspicuous, thus improving the aesthetics of the site 200.

Referring again to FIG. 1, the rails 116 of the slot portion 104 have a height $H_s$. For example, in some embodiments, the height $H_s$ of the rails 116 is about 1 inch to about 6 inches. In certain embodiments, the height $H_s$ of the rails 116 is about 1.5 inches to about 4 inches. In one particular embodiment, the height $H_s$ of the rails 116 is about 2.25 inches.

The height $H_s$ of the rails 116 is configured such that when the trench drain section 100 is installed, an exposed edge portion 118 (which is the upper edge in the illustrated embodiment) is flush with the grade. For example, FIG. 2 shows the exposed edge portion 118 of the rails 116 flush with the grade or surface level 206 of the site 200.

As best shown in FIG. 1, in some embodiments, the channel portion 102 and the slot portion 104 are formed from a single, unitary piece of material. This is accomplished, for example, by bending a single piece of sheet metal to form the channel portion 102 and the slot portion 104. In other embodiments, the channel portion 102 and the slot portion 104 are formed from separate pieces of material which are coupled or secured together (e.g., by welding).

The channel portion 102 and the slot portion 104 of the trench drain section 100 can be formed from various types of material such as steel (e.g., stainless and/or galvanized), aluminum, composite, plastic, etc. In some embodiments, the channel portion 102 and the slot portion 104 are formed from the same type of material. In other embodiments, the channel portion 102 and the slot portion 104 are formed from different types of material. For example, in some embodiments, the channel portion 102 and the slot portion 104 are formed from galvanized steel and/or stainless steel (e.g., type 304 or type 316). In some embodiments, the channel portion 102 and/or the slot portion 104 of the trench drain section 100 comprise a thickness of about 0.01 inches to about 0.3 inches or, in certain embodiments, about 0.05 inches to about 0.18 inches.

As noted above, and as shown in FIG. 1, the gussets 106 are coupled or secured (e.g., welded) to the channel portion 102 and the slot portion 104, external to the internal flow passage 108, so that internal flow passage 108 (i.e., the channel portion 102 and the slot portion 104) is unobstructed by the gussets 106. The gussets 106 are longitudinally spaced apart relative to each other. For example, as shown, one of the gussets 106 is disposed at or near the first end portion 110 of the trench drain section 100 and another gusset 106 is disposed at or near the second end portion 112 of the trench drain section 100. In some embodiments, for example, the spacing between the gussets 106 is between about 1 inch to about 120 inches or about 12 inches to about 30 inches. In one particular embodiment, the spacing between the gussets 106 is 18 inches.

In some embodiments, the spacing between the gussets 106 and/or the number of gussets 106 are configured for various settings and/or applications. For example, in some embodiments, the spacing and/or the number of gussets 106 are configured for a particular load class rating (e.g., Class A, Class B, Class C, etc.).

In other embodiments, the spacing and/or the number of gussets 106 are configured so that the gussets 106 are disposed between pavers, as shown for example in FIG. 2. This configuration allows the gussets 106 to be concealed by the grout (or other fill material) that disposed between the pavers 202.

In other embodiments, the spacing and/or the number of gussets 106 is selected based on the type and/or gauge of the material from which the trench drain 100 (e.g., channel portion 102 and/or slot portion 104) and/or the gussets 106 are formed. For example, a trench drain having a channel portion formed from a lesser strength material such as relatively light gauge stainless steel has gussets that are spaced closer together than a trench drain having a channel portion formed from a stronger material such as relatively heavy gauge stainless steel.

In some embodiments (e.g., as shown), the gussets 106 extend around the perimeter of the channel portion 104. For example, as best shown in FIG. 1, a first end 120 of the gusset 106 is coupled to one of the rails 116 of the slot portion 104, the gusset 106 extends around the perimeter of the channel portion 104, and a second, opposite end 122 of the gusset 106 is coupled to the other rail 116 of the slot portion 104.

In other embodiments, the gussets 106 extend less than all of the way around the perimeter of the channel portion 102. In such embodiments, the first ends 120 of the gussets 106 are coupled to one of the rails 116, and the second ends 122 of the gussets 106 are coupled to side portions 124 of the channel portion 102.

The gussets 106 can be formed from various types of material such as steel, aluminum, composite, plastic, etc. For example, in some embodiments, the trench drain section 100 are formed from galvanized steel and/or stainless steel (e.g., type 304 or type 316). In some embodiments, the gussets 106, the channel portion 102, and the slot portion 104 are formed from the same type of material. In other embodiments, one or more the gussets 106, the channel portion 102, and the slot portion 104 are formed from different types of material. In some embodiments, the gussets 106 comprise a thickness of about 0.01 inches to about 0.3 inches or, in certain embodiments, about 0.05 inches to about 0.18 inches.

Configuring the trench drain section 100 with the gussets 106 provides several advantages. For example, the gussets 106 provide structural support to the rails 116 of the slot portion 104 without interfering with the internal flow passage 108 because the gussets 106 do not extend into the flow passage. As a result, the internal flow passage 108 is unobstructed and is relatively easy to clean. Specifically, the unobstructed internal flow passage 108 makes it easier for a user to insert and move a water jet through the internal flow passage 108 of the trench drain section 100 without having to remove and re-insert the water jet every foot or so to avoid channel supports as required when cleaning typical trench drains. Also, the unobstructed internal flow passage prevents debris from getting caught on channel supports. These features are advantageous, for example, in restaurants and food processing facilities where cleanliness is essential.

In addition, the unobstructed internal flow passage 108 reduces or eliminates tie-off points on the trench drain section 100 which can cause dangerous ligature points. Thus, the trench drain section 100 is safer than typical trench drains, for example, in behavioral health environments such as mental health care facilities.

The gussets 106 also advantageously allow the rails 116 of the slot portion 104 to be relatively thin, while also having sufficient strength to prevent the slot portion 104 from collapsing. As such, only the exposed edge portion 118 of the rails 116 is exposed when the trench drain section 100 is installed. This allows the trench drain section 100 to blend into a grout lines or concrete joint lines, thus making the trench drain system 100 discrete and aesthetically pleasing.

In some embodiments, the trench drain section 100 are pre-sloped such that fluid entering the flow passage 108 flows through the channel portion 102 in one direction. This can be accomplished, for example, by forming the trench drain section 100 such that the height $H_s$ of the slot portion 104 and/or a height $H_c$ of the channel portion 102 is greater at the first end 110 of the channel portion 102 than at the second end 112 of the channel portion 102. In such embodiments, the trench drain section 100 slopes toward the first end portion 110 of the trench drain section when the exposed edges 118 of the slot portion 104 are installed level with the grade (i.e., because the first end portion 110 of the trench drain section 100 is lower than the second end portion 112 of the trench drain section).

In other embodiments, the trench drain section 100 is configured to be substantially flat. This can be accomplished, for example, by forming the trench drain section 100 such that the height $H_s$ of the slot portion 104 and/or the height $H_c$ of the channel portion 102 are substantially equal along the entire length of the trench drain section 100).

As noted above, FIG. 2 shows the trench drain section 100 installed at the site 200. As shown, the trench drain section 100 is disposed in a trench 208 and concrete 210 is poured around the channel section 102 of the trench drain section 100 to secure the trench drain section 100 in place. Pavers 202 (or, e.g., a concrete slab) are then be placed on top of the concrete 210, and the rails 116 of the slot portion 104 (FIG. 1) of the trench drain section 100 are aligned between the pavers 202 such that the slot portion 104 blends in with the grout lines 204 (or, e.g., the joint lines of the concrete slab). As also shown and noted above, the height $H_s$ of the slot portion 104 is configured so that the exposed edges 118 of the rails 116 are flush with the grade (or surface level) 206. In addition, FIG. 2 shows the gussets 106 configured so that the gussets 106 are disposed between pavers 202, as noted above.

In another embodiment, a method of cleaning a trench drain section and/or a plurality of trench drain sections is provided. For example, a method of cleaning the trench drain section 100 comprises inserting the tip of a power washer into the internal flow passage 108 via the slot portion 104 and moving the tip of the power washer longitudinally along the internal flow passage 108 in a continuous motion, thereby removing build-up or debris from the internal flow passage 108. In some embodiments, the method of cleaning the trench drain section 100 comprises inserting a cleaning tool (e.g., a brush, a scraper, etc.) into the internal flow passage 108 via the slot portion 104 and moving the cleaning tool through the internal flow passage 108 from the first end 110 of the channel portion 102 to the second end 112 of the channel portion 102 in a continuous motion. The trench drain section 100 is therefore relatively easier to clean than a typical trench drain, which requires a user to remove the tip of a power washer and/or other cleaning tool from the trough of the trench drain at each internal support member of the trench drain, and thus prevents the user from cleaning the trench drain in a continuous motion.

Figure 3:
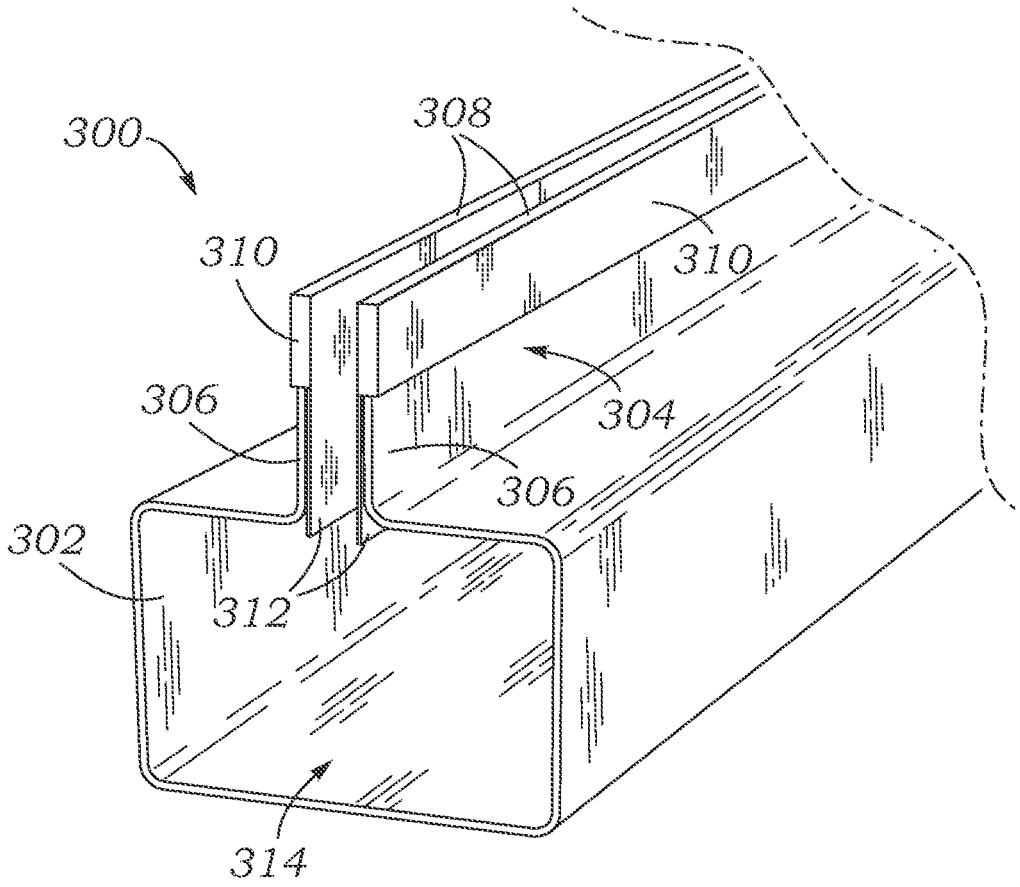
FIG. 3 is a perspective view of an example of a trench drain, according to another embodiment.

FIG. 3 shows an example of a trench drain section 300, according to another embodiment. The trench drain section 300 comprises a channel portion 302, a slot portion 304 having rails 306, and one or more gussets (not shown). The trench drain section 300 is configured similar to the trench drain section 100 shown, e.g., in FIGS. 1-2. The trench drain section 300 also has one or more trim elements 308 (e.g., two in the illustrated embodiment). The trim elements 308 are disposed on and at least partially cover a respective rail 306 of the slot portion 304, as further described below.

The trim elements 308 each comprise a receiving or sleeve portion 310 and an extension portion 312. Each of the sleeve portions 310 are configured to be disposed over and receive a respective exposed edge (not shown, but see, e.g., exposed edge 118 in FIG. 1) of the rails 306. The extension portions 312 are configured to extend from a respective sleeve portion 310, adjacent to a respective rail 306, and into an internal flow passage 314 of the trench drain section 300. When the trench drain section 300 is installed, the fill material (e.g., concrete) flows around the rails 306 and the trim elements 308 to seal any gap created by a difference in thickness between the trim elements 308 and the rails 306.

In some embodiments, the trim elements 308 are removably coupled or secured to the rails 306 of the trench drain section 300 so that the trim elements 308 can be removed, replaced, and/or exchanged. The trim elements 308 can be replaced, for example, when the trim element 308 becomes heavily soiled or damaged. The trim elements 308 can also be exchanged for trim elements that, for example, have a different color, have a different type of finish, and/or are formed from a different type of material. Configuring the trench drain section 300 with the trim elements 308 thus allows the trench drain section 300 to be aesthetically pleasing and adapted to various settings.

In some embodiments, the channel portion 302 and the slot portion 304 are formed from a relatively less-expensive and/or a more malleable material, the trim elements 308 are formed from a material with the desired aesthetics and/or other properties, and the trim elements 308 are placed over the rails 306 of the slot portion 304 to provide the desired aesthetics and/or structure.

Figure 4:
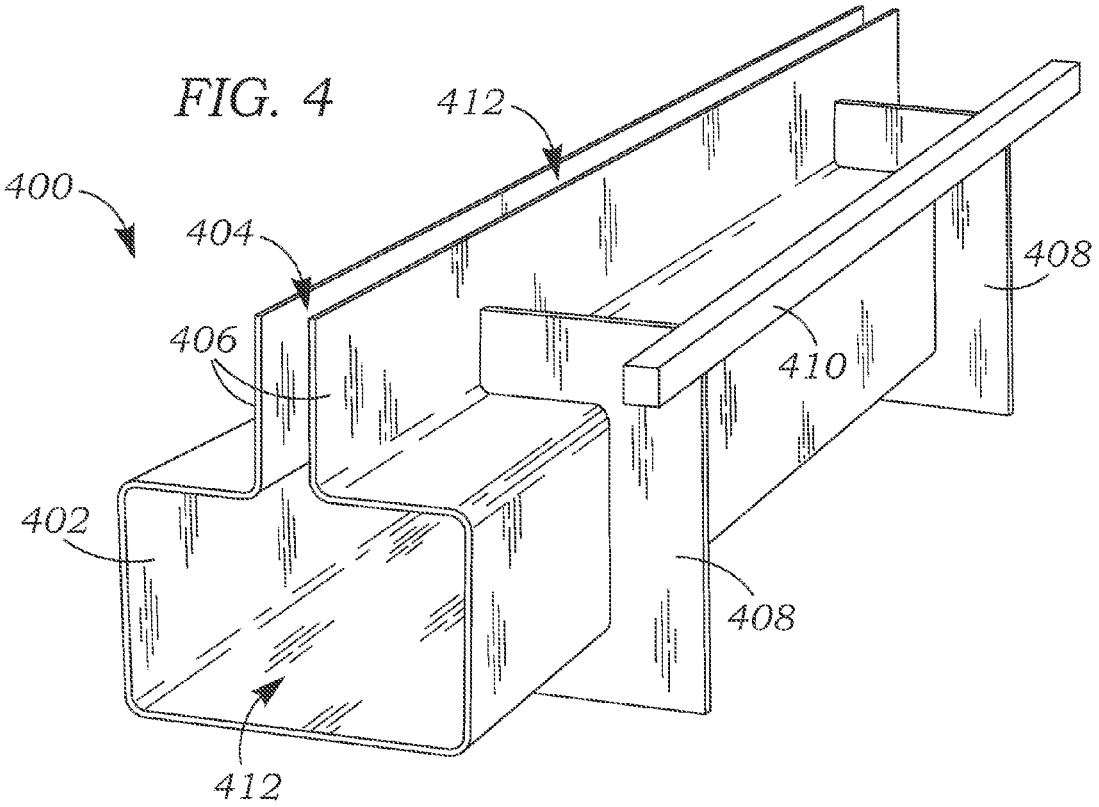
FIG. 4 is a perspective view of an example of a trench drain, according to another embodiment.

FIG. 4 shows an example of a trench drain section 400, according to another embodiment. The trench drain section 400 comprises a channel portion 402, a slot portion 404 having rails 406, and one or more gussets 408 (e.g., two in the illustrated embodiment). The trench drain section 400 is configured similar to the trench drain section 100 shown, e.g., in FIGS. 1-2. The trench drain 400 also comprises at least one reinforcing or support member 410 (e.g., one shown in the illustrated embodiment).

The support member 410 is an elongate tube or bar which extends longitudinally between and interconnects a plurality of gussets 408. The support member 410 is coupled or secured to the gussets 408, for example, by welding, fasteners, etc. In some embodiments, the gussets 408 comprise attachment locations (e.g., notches or openings) in which the support member 410 is disposed and/or secured. The support member 410 is configured to provide increased support to the gussets 408 and, thus, the rails 406 of the slot portion 404 without interfering with an internal flow passage 412 trench drain section 400.

Also, the support member 410 is configured so as to be disposed below the grade or surface level when the trench drain section 400 is installed. In such a configuration, the support member 410 advantageously improves the strength of the trench drain section 400 during manufacturing, transportation, and installation without disrupting the aesthetics of the installed trench drain section 400.

In some embodiments, the support member 410 is configured to extend along and to be coupled or secured to more than one trench drain section 400. This configuration allows the support member to be used to align and or couple multiple trench drain sections 400 as part of a trench drain system.

Although not shown, in some embodiments, each of the gussets 408 (or additional gussets) of the trench drain section 400 extend around the perimeter of the channel portion 402 section 400 and are coupled to the other rail 406 of the slot portion 404. In some of those embodiments, the trench drain section 400 comprises one or more additional support members which are coupled or secured to the gussets on the other side of the slot portion 404 (e.g., the side opposite from the support member 410). Also, although not shown, in some embodiments, the trench drain section 400 has more than one support member 410 on each side of the slot portion 404.

Although not shown, in some embodiments, the support member 410 is coupled to a respective gusset 408 and to the channel portion 402, such as by welding, fasteners, etc. In particular embodiments, the support member 410 extends from the gusset 408 to the channel portion 402 at an angle (e.g, 45 degrees).

Figure 5:
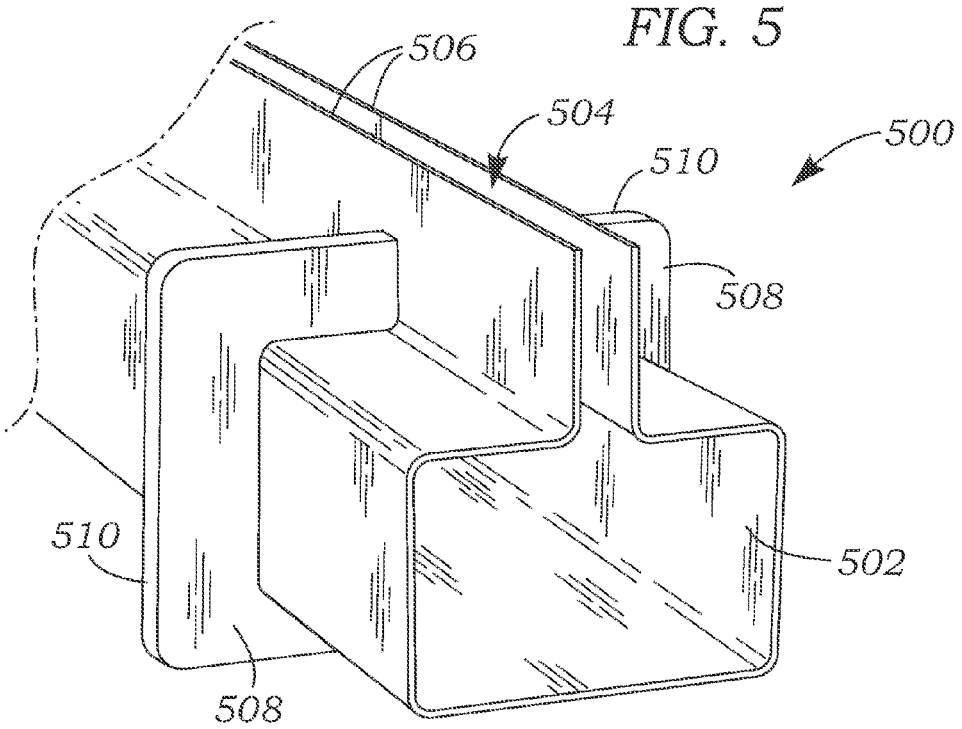
FIG. 5 is perspective view of an example of a trench drain, according to another embodiment.

FIG. 5 shows an example of a trench drain section 500, according to another embodiment. The trench drain section 500 comprises a channel portion 502, a slot portion 504 having rails 506, and one or more gussets 508 (e.g., one shown in the illustrated embodiment). The trench drain section 500 is configured similar to the trench drain section 100 shown, e.g., in FIGS. 1-2.

The gussets 508 of the trench drain section 500 comprise curved or rounded outwardly facing edge surfaces 510. In some embodiments, the outwardly facing edge surfaces 510 are curved or rounded, for example, by forming the gussets 508 from rolled or bar type stock material. In other embodiments, the gussets 508 are formed from sheet metal and the outwardly facing edge surfaces 510 are bent to curve or round the outwardly facing edge surfaces 510. In particular embodiments, only the top outwardly facing edge is rounded and/or rolled.

Forming the gussets 508 with curved or rounded outwardly facing edge surfaces 510 advantageously reduces stress concentrations on the material that surrounds the gussets 508 (e.g., concrete) when the trench drain section 500 is installed. This, in turn, helps to prevent cracks from forming and/or promulgating in the material that is adjacent to the gussets 510.

Figure 6:
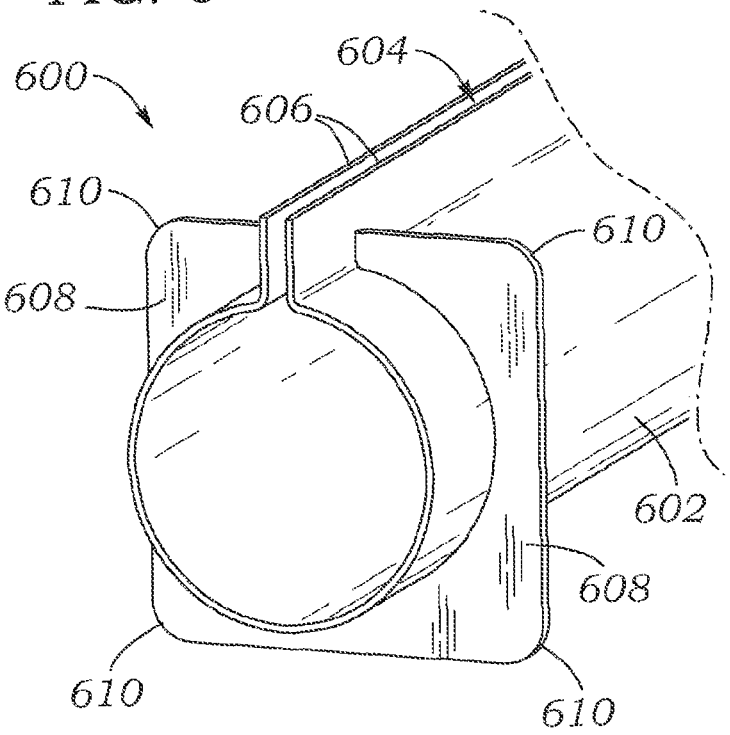
FIG. 6 is perspective view of an example of a trench drain, according to another embodiment.

FIG. 6 shows an example of a trench drain section 600, according to another embodiment. The trench drain section 600 is configured similar to the trench drain section 100 (shown, e.g., in FIGS. 1-2) and comprises a channel portion 602, a slot portion 604 having rails 606, and one or more gussets 608 (e.g., one shown in the illustrated embodiment). As shown, the channel portion 602 has a generally circular cross-section shape. As also shown, the gussets 608 have curved or rounded outwardly facing corners 610.

Figure 7:
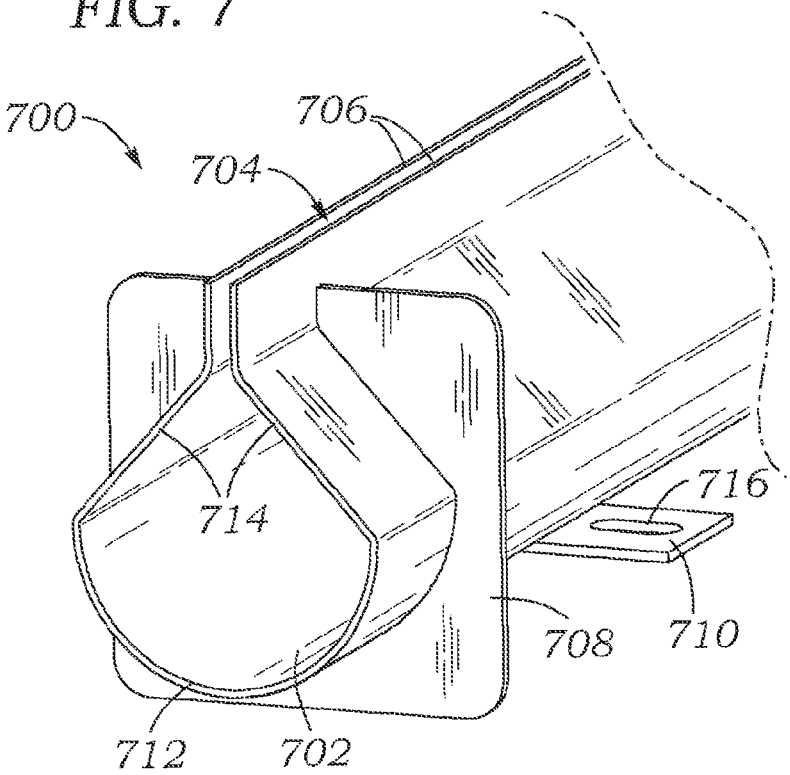
FIG. 7 is perspective view of an example of a trench drain, according to another embodiment.

FIG. 7 shows an example of a trench drain section 700, according to another embodiment. The trench drain section 700 is configured similar to the trench drain section 100 (shown, e.g., in FIGS. 1-2) and comprises a channel portion 702, a slot portion 704 having rails 706, one or more gussets 708 (e.g., one shown in the illustrated embodiment), and one or more mounting member 710.

As shown, the channel portion 702 has a generally curved or rounded lower portion 712 and angled or sloped side portions (which is also called a shoulder) 714. The sloped side portions 714, for example, allow more fill material (e.g., concrete) to be disposed above the channel portion 702, which advantageously provides increased reinforcement.

The mounting member 710 comprises an opening 716 which extends through the mounting member 710. The mounting member 710 is used, for example, to adjustably couple or secure the trench drain section 700 to a mounting or installation member (e.g., a bracket, a stand, rebar, etc.) via a fastener (e.g. a bolt, a tie, etc.) which is used to position the trench drain section 700 during an installation process. Additional details regarding mounting and installation members, as well as trench drain installation, are found, for example, in U.S. patent application Ser. No. 14/699,798 which is incorporated by reference herein in its entirety.

In view of the many possible embodiments to which the principles of the disclosure may be applied, it should be recognized that the illustrated embodiments are only examples and should not be taken as limiting the scope of the disclosure.

What is claimed is:

1. A trench drain comprising:

first and second end portions;

first and second side portions;

a channel portion extending longitudinally from the first end portion to the second end portion;

a continuous, unobstructed slot portion extending from and in fluidic communication with the channel portion, wherein the slot portion and the channel portion form an internal flow passage, and wherein the slot portion has a first width that is less than a second width of the channel portion; and at least one gusset coupled to the slot portion and the channel portion and disposed external to the internal flow passage, wherein the at least one gusset extends from the first side portion, around the channel portion, and to the second side portion, and wherein the at least one gusset is longitudinally spaced from the first and second end portions of the channel portion.

2. The trench drain of claim 1, wherein the internal flow passage is unobstructed.

3. The trench drain of claim 1, wherein the slot portion comprises two laterally spaced rails which are coupled to and extend from the channel portion.

4. The trench drain of claim 3, wherein each of the rails comprises an exposed edge portion when the trench drain is installed, and a thickness of each of the exposed edge portions of the rails is the same as a thickness of a wall of the channel portion.

5. The trench drain of claim 3, further comprising trim elements disposed over respective rails of the slot portion.

6. The trench drain of claim 5, wherein the trim elements are removable after the trench drain is installed.

7. The trench drain of claim 3, wherein the channel portion and the slot portion are formed from a single, unitary piece of material.

8. The trench drain of claim 3, wherein the channel portion and the slot portion each comprise a thickness, and the thickness of the channel portion and the thickness of the slot portion are substantially the same.

9. The trench drain of claim 1, wherein the trench drain further comprises at least one additional gusset coupled to the slot portion and the channel portion and disposed external to the internal flow passage, wherein the at least one additional gusset is longitudinally spaced from the at least one gusset.

10. The trench drain of claim 9, further comprising a support member coupled to and extending between the at least one gusset and the at least one additional gusset.

11. The trench drain of claim 10, wherein each of the gussets comprises an attachment location for receiving the support member.

12. The trench drain of claim 9, further comprising a first support member coupled to and extending between the at least one gusset and the at least one additional gusset and which is disposed on a first side of the slot portion, and a second support member coupled to and extending between the at least one gusset and the at least one additional gusset and which is disposed on a second side of the slot portion.

13. The trench drain of claim 1, wherein the gusset comprises a rounded or rolled edge portion.

14. The trench drain of claim 1, wherein the trench drain is formed from stainless steel.

15. The trench drain of claim 1, wherein the trench drain is formed from galvanized steel.

16. The trench drain of claim 1, wherein the trench drain is formed from plastic.

17. The trench drain of claim 1, wherein inwardly facing surfaces of the slot portion are exposed in the internal flow passage.

18. A trench drain comprising:

first and second end portions;

a channel portion extending longitudinally from the first end portion to the second end portion;

a continuous slot portion having two rails extending from the channel portion, wherein the slot portion has a first width that is less than a second width of the channel portion, wherein the slot portion and the channel portion are in fluidic communication and form an unobstructed, internal flow passage, and wherein the channel portion and the slot portion are formed from a single, unitary piece of material, and inwardly facing surfaces of the slot portion are exposed in the internal flow passage; and at least one gusset coupled to the rails of the slot portion and to the channel portion and disposed external to the internal flow passage.

19. The trench drain of claim 18, wherein the at least one gusset is a plurality of gussets, and the gussets are longitudinally spaced apart relative to each other and are longitudinally spaced from the first end portion and the second end portion.

20. The trench drain of claim 19, wherein the channel portion, the slot portion, and the gussets are formed from sheet metal.

21. The trench drain of claim 18, wherein the at least one gusset extends from a first rail of the two rails, around the channel portion, and to the second rail of the two rails, and wherein the at least one gusset is longitudinally spaced from the first and second end portions.

* * * * *